US005135028A

United States Patent [19]

Rickenbach et al.

[11] Patent Number: 5,135,028

[45] Date of Patent: Aug. 4, 1992

[54] REMOTELY OPERATED FLOW CONTROL SYSTEM

[76] Inventors: Kirsten L. Rickenbach; Andreas Rickenbach, both of 1610 Christy Hill Rd., #C-11, Olympic Valley, Calif. 94146

[21] Appl. No.: 716,517

[22] Filed: Jun. 17, 1991

[51] Int. Cl.[5] ..... F16K 11/10

[52] U.S. Cl. ..... 137/599; 137/607

[58] Field of Search ..... 251/295, 129.04, 629.15; 137/607, 599

[56] References Cited

U.S. PATENT DOCUMENTS

| | | | |
|---|---|---|---|
| 2,181,423 | 11/1939 | Gille | 251/129.15 X |
| 2,188,258 | 1/1940 | Zinkil | 251/295 X |
| 2,264,876 | 12/1944 | Hackley | 251/295 X |
| 2,830,618 | 4/1958 | Mitchell | 251/295 X |
| 2,968,466 | 1/1961 | McGoldrick | 251/129.15 X |
| 3,638,680 | 2/1972 | Kopp | 137/607 X |

*Primary Examiner*—Alan Cohan

[57] ABSTRACT

An apparatus having a pair of normally closed solenoid valves is retrofitted between hot and cold water inlets and a mixing faucet. Each valve includes a bypass with a mechanically operated valve. A flexible conduit is used to connect each of the valves to the faucet. A switch and an electrical circuit is used to simultaneously open the solenoid valves.

1 Claim, 1 Drawing Sheet

REMOTELY OPERATED FLOW CONTROL SYSTEM

FIELD OF THE INVENTION

The present invention relates to apparatus for use in controlling flow of water through hot and cold water conducts to a sink or the like using a remotely located pressure switch to control flow through normally closed valves located on the hot and cold water conducts.

BACKGROUND OF THE INVENTION

Many areas of the country have had severe water shortages during recent years. California in particular has recently had several years of drought and water conservation is of prime importance. In Marin County, Calif., for example, water rationing permitted only 50 gallons per day per household member. Conservation is a necessity under this type of rationing.

Household plumbing which is used to supply water to sinks typically includes an uniflow faucet at the sink which is connected to a hot water conduct and a cold water conduct. The faucet is manually adjusted to provide a desirable flow rate and temperature. Because the faucet is hand operated, much water can be wasted during operation. There is therefore needed for apparatus which can easily be installed into existing plumbing or installed with new plumbing which permits control of water without use of the hands.

SUMMARY OF THE INVENTION

The present invention provides apparatus for use in controlling the flow of water to a sink or the like through a uniflow mixing faucet connected to a hot water conduct and a cold water conduct. A first normally closed valve means is adopted to be connected into the hot water conduct and a second normally closed valve means is adopted to be connected into the cold water conduct. A remote pressure activated switch means is operably connected to the first normally closed valve means and the second normally closed valve means and is responsive to pressure to simultaneously open the first valve means and the second valve means to flow water to the uniflow mixing faucet. In preferred form the first and the second normally closed valves are solenoid valves and the switch means includes a foot switch responsive to foot pressure, operationally connected to an electrical circuit for simultaneously opening the valves. It is also contemplated that mechanical switch means may be used. In one aspect it may be desirable to provide first bypass conduct connected across then normally closed first solenoid valve means and a mechanically operated valve means for opening and closing the first bypass conduct to water flow. A second bypass conduct is connected across the normally closed second solenoid valve means. A mechanically operated valve means is provided for opening and closing the second bypass conduct to water flow. This arrangement permits returning the system to normal operation if desired.

OBJECT OF THE INVENTION

A principal object of the present invention is to provide a flow control system for controlling water flow to a sink or the like by utilizing normally closed valves in hot and cold waterlines which are controlled by a remotely controlled switch.

It is also an object of the present invention to provide such a flow control system which is readily retrofitted into the existing plumbing of a sink or the like without need to connect the plumbing through the switch itself. Further objects and advantages of the present invention will become apparent from the following description and drawing.

DETAILED DESCRIPTION OF THE INVENTION

Figure 1:
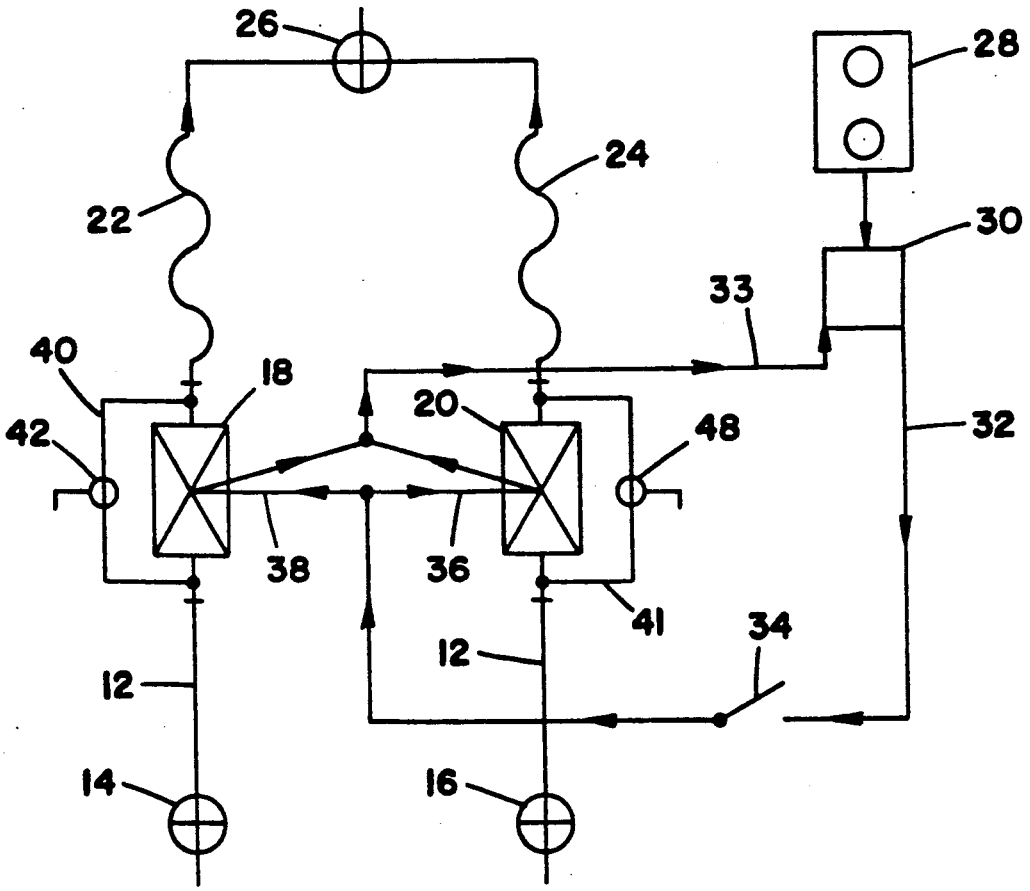
FIG. 1 is a schematic diagram illustrating a preferred embodiment of apparatus assembled in accordance with the present invention.

Referring specifically to FIG. 1 where a preferred embodiment of apparatus assembled in accordance with the present invention is shown. An uniflow mixing faucet 26 is used to control the flow of water into a sink or the like (not shown). A source of hot water is provided for flow to the sink through conduct 10 and manual valve 14. A source of cold water may flow to the sink through manual valve 16 and conduct 12. In conventional operation valves 14 and 16 are open and the rate of flow of water and the temperature of the water going to the sink are controlled by manually adjusting the uniflow mixing faucet 26.

In accordance with the preferred embodiment of the present invention a first normally closed valve, for example normally closed solenoid valve 18, is connected to the hot water conduct 10 and is conveniently located between manual valve 14 and the uniflow mixing faucet 26. A flexible conduct 22 connects the out flow from the solenoid valve 18 to the mixing faucet 26. The use of a flexible conduct 22 greatly facilitates retro fitting the apparatus of the present invention into the conventional piping of a sink.

In a similar manner a second normally closed valve, for example normally closed solenoid valve 20, is connected to the cold water conduct 12 and is located between manual valve 16 and the mixing faucet 26. A flexible conduct 24 connects the outflow from solenoid valve 20 to mixing faucet 26. When the hot and cold water conducts are controlled as discussed above; i.e. manual valves 14 and 16 open and solenoid valves 18 and 20 close, no water will flow through the mixing faucet 26 whether or not it is open.

In accordance with the invention, mixing faucet 26 is adjusted for the desired rate, and temperature of water flow and a remote pressure activated switch means is used to simultaneously open the first normally closed valve means and the second normally closed valve means to allow for waterflow to the sink through the mixing faucet 26.

The normally closed solenoid valves 18 and 20 are connected by suitable electrical circuitry 38, 36, 33 and 32 to a conventional house power outlet 28. It is often desirable to reduce the voltage for example to 24 volts, in the circuit by interposing a transformer 30. A pressure activated switch 34 is connected into the electrical circuit remote from the hot and cold water conducts for activating and deactivating solenoid valves 18 and 20. *The switch 34 is normally in the open position thus allowing the valves 18 and 20 to remain closed. *When pressure, such as foot pressure, is applied to the switch 34, the solenoid valves 18 and 20 are opened to permit water flow. When pressure is released from the switch 34, the solenoid valves 18 and 20 revert to their normally closed position.

A first bypass conduct 40 is desirably connected between hot water conduct 10 and the outflow from solenoid valve 18 into flexible conduct 22. A manual valve 42 controls flow through the bypass conduct 40 and in normal operation is in the closed position. Similarly a second bypass conduct 41 is connected between cold water conduct 12 and the outflow from the solenoid valve 20 into flexible conduct 24. A normally closed manual valve 48 controls flow through bypass conduct 41. Thus, if it is desired to return to conventional operation of the system, valves 42 and 48 are opened and water flow to the sink is controlled manually by the mixing faucet 26. This is an especially important feature should electrical power be lost leaving the solenoid valves closed.

Figure 2:
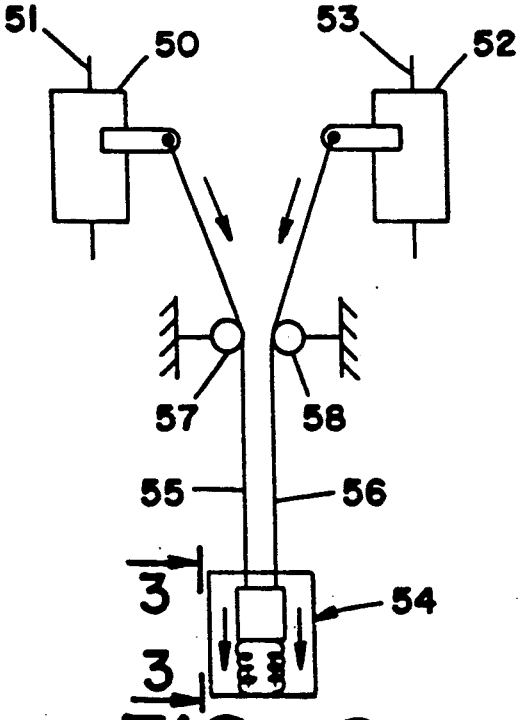
FIG. 2 is a schematic diagram illustrating an alternative embodiment of apparatus assembled in accordance with the present invention.
Figure 3:
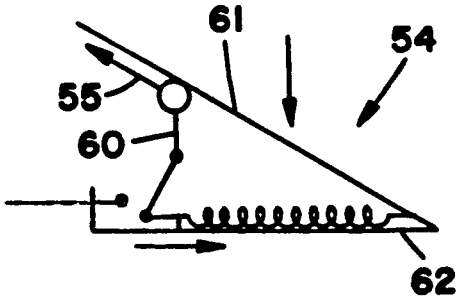
FIG. 3 is a sectional view taken at line 3—3 of FIG. 2.

Refer now to 1 FIG. 2 and 3 where an alternative embodiment of apparatus assembled in accordance with the present invention is shown. This alternative embodiment of apparatus includes mechanically operated valves for controlling flow to a uniflow faucet utilizing a mechanically operated remotely located switch means.

A hot water conduct 51 and a cold water conduct 53 are connected between an uniflow mixing faucet and manually operated valves in a similar manner as illustrated in FIG. 1. On the embodiment of FIG. 2 and 3 mechanically operated normally closed ball valves 50 and 52 prevent flow of hot and cold water through conducts 51 and 53 to the mixing faucet. *The valve stems of valves 50 and 52 are connected to a remotely located pressure switch 54 by suitable cables 55, 56 through the cable supports 57 and 58. *When spring loaded valve 54 is depressed the valves 50 and 52 are opened and water flows to the sink via the mixing faucet.

FIG. 3 schematically illustrates a suitable remote pressure switch useful in the present invention. Thus pressure switch 54 includes a foot pedal 61 held in a normally upright position by spring 62. The switch is connected through appropriate linkage 60 to cable 55 so that when the foot pedal is depressed the valves 50 and 52 open to allow water flow.

Although specific embodiments of the present invention are described in detail the invention is not to be so limited by these specific embodiments but is meant to include all of the embodiments within the scope of the appended claims.

We claim:

1. Apparatus for retrofitting into the conventional piping of a sink for use in controlling flow of water to the sink or the like through a uniflow mixing faucet connected to a hot water conduct and a cold water conduit comprising first normally closed solenoid valve means having an inflow and an outflow, said inflow adapted to be connected into the hot water conduit below said first normally closed solenoid valve means, a first bypass conduit connected across said normally closed first solenoid valve means immediately adjacent said inflow and said outflow, a mechanically operated valve means on said first bypass conduit for opening and closing said first bypass conduit to water flow, a flexible conduit connected to said first normally closed solenoid valve means immediately above the outflow therefrom and adapted to be connected to said hot water conduit, second normally closed solenoid valve means having an inflow and an outflow, said inflow adapted to be connected into said cold water conduit immediately below said second normally closed solenoid valve means, a second bypass conduit connected across said normally closed second solenoid valve means immediately adjacent said inflow and said outflow, a mechanically operated valve means on said second bypass conduit for opening and closing said second bypass conduit to water flow, a flexible conduit connected to said second normally closed solenoid valve immediately above the outflow therefrom and adapted to be connected to said cold water conduit, and pressure activated switch means operably connected to an electrical circuit for simultaneously opening said normally closed first and second solenoid valves.

* * * * *